US006341382B1

(12) United States Patent
Ryvin et al.

(10) Patent No.: US 6,341,382 B1
(45) Date of Patent: Jan. 29, 2002

(54) ONE-PIECE ADJUSTABLE HEADGEAR SUPPORT

(75) Inventors: David M. Ryvin, Williamsville; Christopher J. Lundgren, Victor, both of NY (US)

(73) Assignee: Jackson Products, Inc.

( * ) Notice: Subject to any disclaimer, the term of this patent is extended or adjusted under 35 U.S.C. 154(b) by 0 days.

(21) Appl. No.: 09/707,057

(22) Filed: Nov. 6, 2000

(51) Int. Cl.[7] ..... A42B 1/22

(52) U.S. Cl. ..... 2/417; 2/418; 2/DIG. 11; 24/16 PB

(58) Field of Search ..... 2/417, 418, 419, 2/421, DIG. 11, 183, 195.2; 24/580, 581, 584, 585, 664, 647, 615, 16 PB

(56) References Cited

U.S. PATENT DOCUMENTS

| | | | | |
|---|---|---|---|---|
| 1,072,498 | A | | 9/1913 | Redmond |
| 1,868,718 | A | | 7/1932 | Norton |
| 3,079,609 | A | | 3/1963 | Hoffmaster |
| 3,129,431 | A | | 4/1964 | Haney |
| 3,156,922 | A | * | 11/1964 | Anderson |
| 3,156,923 | A | * | 11/1964 | Timm |
| 3,221,340 | A | * | 12/1965 | Joffe |
| 3,228,082 | A | * | 1/1966 | Skerry |
| 3,500,474 | A | | 3/1970 | Austin |
| 3,752,157 | A | * | 8/1973 | Malmin |
| 3,866,244 | A | * | 2/1975 | Ruck |
| 3,992,720 | A | * | 11/1976 | Nicolinas |
| 4,292,692 | A | | 10/1981 | Moretti et al. |
| 4,827,796 | A | | 5/1989 | Horian |
| 4,951,362 | A | * | 8/1990 | Denemark et al. |
| 4,999,846 | A | | 3/1991 | Ball et al. |
| 5,077,836 | A | | 1/1992 | Idoff et al. |
| 5,642,555 | A | | 7/1997 | Lin |
| 5,774,953 | A | | 7/1998 | Mao |
| 5,806,101 | A | | 9/1998 | Thruwanger et al. |
| 5,852,852 | A | | 12/1998 | Rigal |
| 5,896,586 | A | | 4/1999 | Freund |

* cited by examiner

*Primary Examiner*—Rodney M. Lindsey
(74) *Attorney, Agent, or Firm*—Dunlap, Codding & Rogers

(57) ABSTRACT

A one-piece adjustable headgear strap is constructed of lightweight material, for example plastic, and therefore is inexpensively manufactured and comfortable to wear. The strap is constructed with an adjustment mechanism that enables it to be easily adjusted around the head of wearer with just one hand. The adjustment mechanism is also integrally formed with the headband of the headgear support and is therefore inexpensive to manufacture due to its one-piece construction.

8 Claims, 3 Drawing Sheets

ONE-PIECE ADJUSTABLE HEADGEAR SUPPORT

BACKGROUND OF THE INVENTION (1) Field of the Invention

The present invention pertains to an adjustable headgear support for use with protective headgear such as construction hard hats, fire fighter helmets, welding helmets and the like. In particular, the present invention pertains to a one-piece adjustable headgear support that is lightweight and therefore comfortable to the wearer, can be easily adjusted around the head of the wearer with just one hand, and is inexpensive to manufacture due to its one-piece construction.

(2) Description of the Related Art

Protective headgear, for example construction hard hats, welding helmets, fire fighter helmets and the like typically include headgear supports with headbands or head straps that are adjustable so that the headgear can be supported comfortably on any size head by the headband. However, in many prior art headgear supports the headband adjustment mechanism is difficult to operate and requires that the headgear be removed from the head in order to make adjustments in the size of the loop formed by the headband. To overcome this inconvenience, headgear headbands were designed that could be adjusted while worn on the head of the user. However, many prior art headgear headbands designed to be adjusted while worn on the head of the user would not reliably operate to both decrease the size of the loop formed by the headband and increase the size of the loop formed by the headband. In addition, some prior art designs that did operate reliably required a construction of several separate component parts. For example, some headgear headbands have manual knobs that are easily rotated by hand in opposite directions to increase or decrease the size of the loop formed by the headband. These multiple part designs increase the cost of manufacturing the adjustable headgear headband.

What is needed to overcome the disadvantages associated with protective headgear adjustable headbands is a headband construction that is inexpensive to manufacture, can be easily adjusted increasing its loop size or decreasing its loop size, and does not compromise the comfort of the user.

SUMMARY OF THE INVENTION

The headgear support of the invention overcomes disadvantages of prior art headgear supports by providing a headband that is of one-piece construction and includes an adjustment mechanism that can be operated by one hand of the headgear wearer. The headband of the headgear support has a length between opposite ends that is sufficiently large to wrap around the head of a user with the opposite ends overlapping. An adjustable cross-over band crosses over the top of the head of the user and is also formed as one piece with the headband. The headband is formed with a clasp at one of its ends and a series of catches at its opposite end, where individual catches can be engaged by the clasp to hold the headband in an adjusted loop configuration around the user's head. A pair of finger abutments, one formed on the clasp and the other formed at the end of the series of catches, can be squeezed together by the thumb and forefinger of a user to pass the series of catches through the clasp when adjusting the size of the headband around the head of a user. The clasp is integrally connected to the headband by a pair of torsion arms on opposite sides of the clasp. The clasp has a pawl that engages with the series of catches on one side of the torsion arms and a finger tab on the opposite side of the torsion arms. By pressing inwardly on the finger tab the clasp is pivoting about the torsion arms causing the pawl to disengage from the catches, thereby enabling the loop configuration of the headband to be enlarged using just one hand.

All of the component parts of the headgear support are preferably molded of plastic and are integrally connected together giving the headgear support an inexpensive and simple to operate construction.

BRIEF DESCRIPTION OF THE DRAWINGS

Further features of the invention are set forth in the following detailed description of the preferred embodiment of the invention and in the drawing figures wherein.

DETAILED DESCRIPTION OF THE PREFERRED EMBODIMENT

Figure 1:
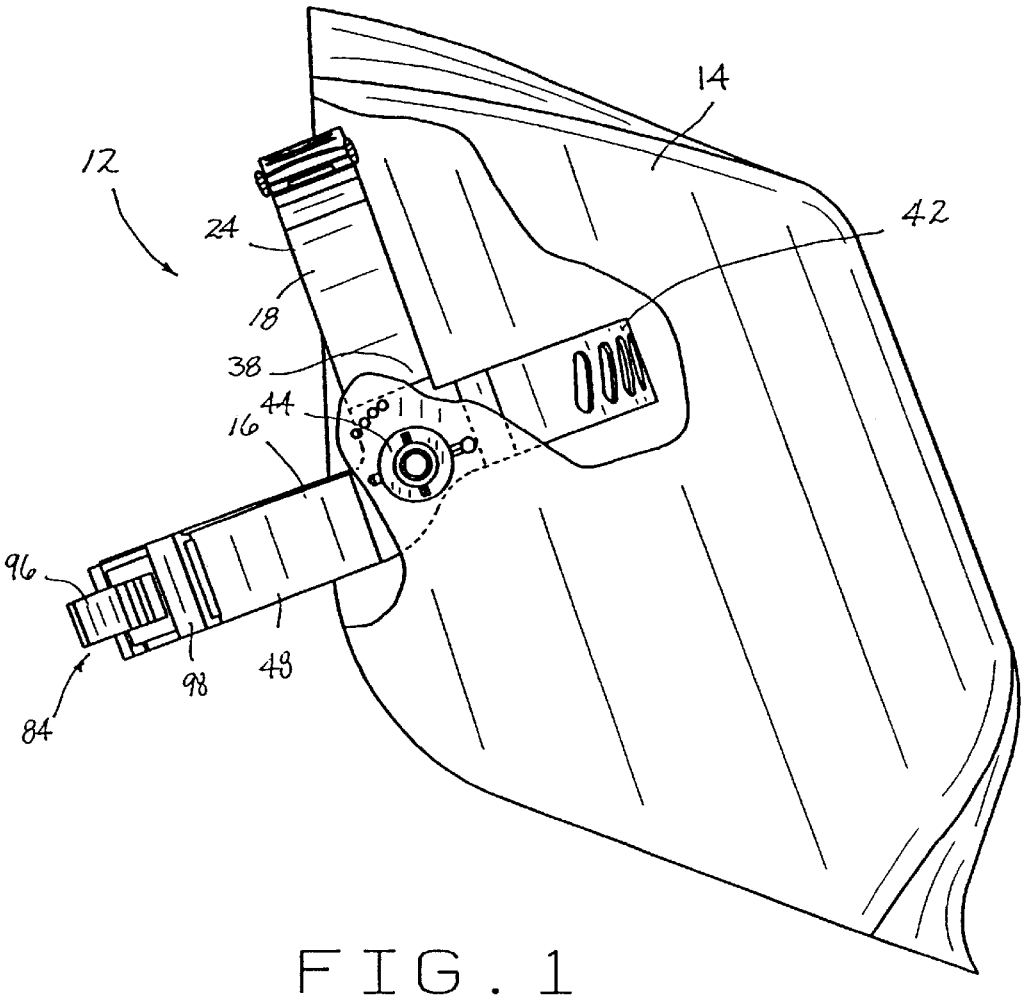
FIG. 1 is a side elevation view of the one piece adjustable headgear support of the invention employed in one operative environment of the headgear support.
Figure 2:
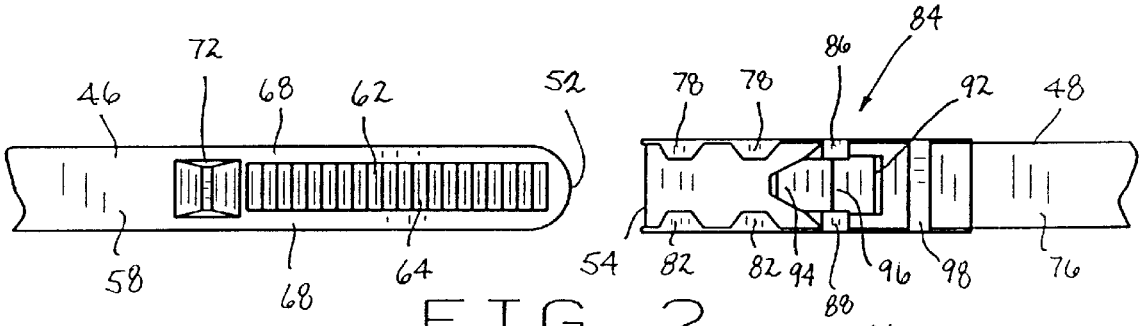
FIG. 2 is a partial plan view of a pair of headband straps of the headgear support having size adjustment mechanisms.
Figure 3:
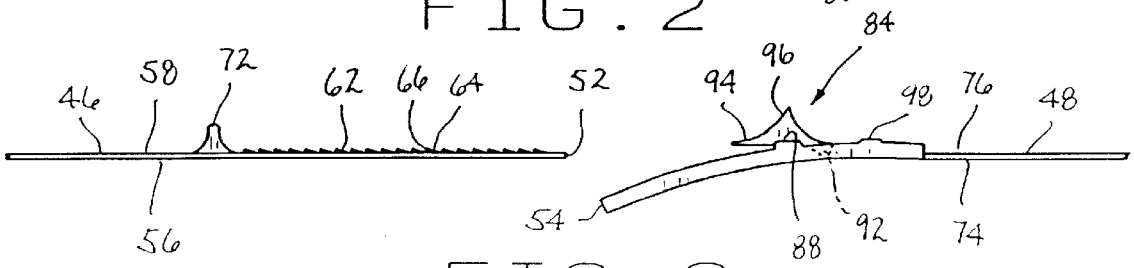
FIG. 3 is a side elevation view of the headgear straps of FIG. 2.
Figure 4:
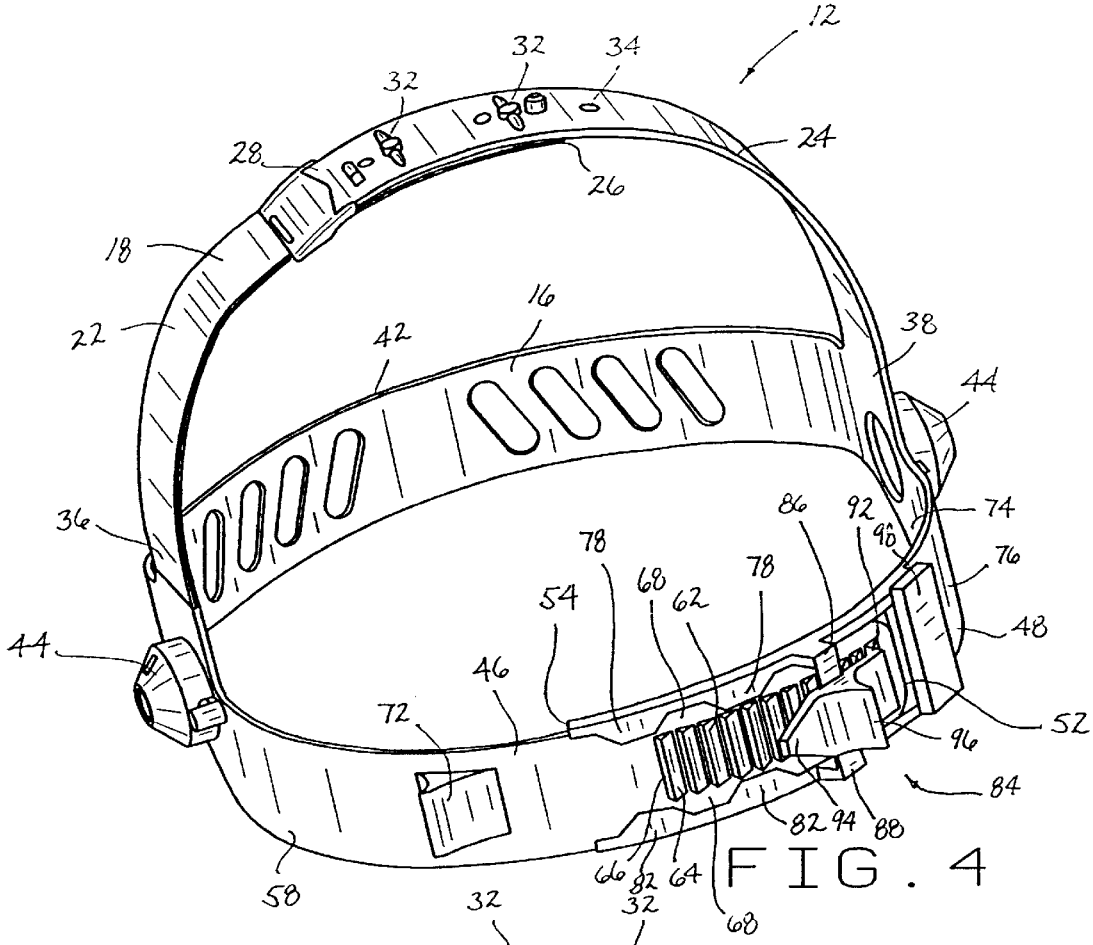
FIG. 4 is a perspective view of the rear of the headgear support removed from its operative environment of FIG. 1.
Figure 5:
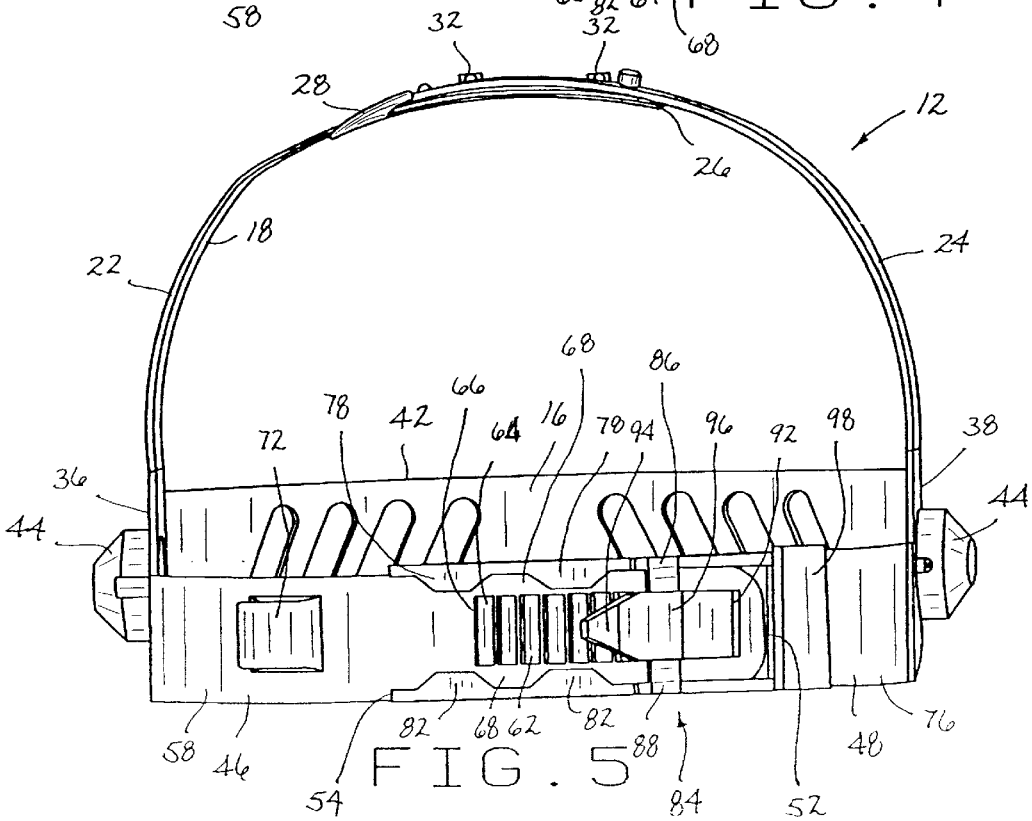
FIG. 5 is a rear elevation view of the headgear support.
Figure 6:
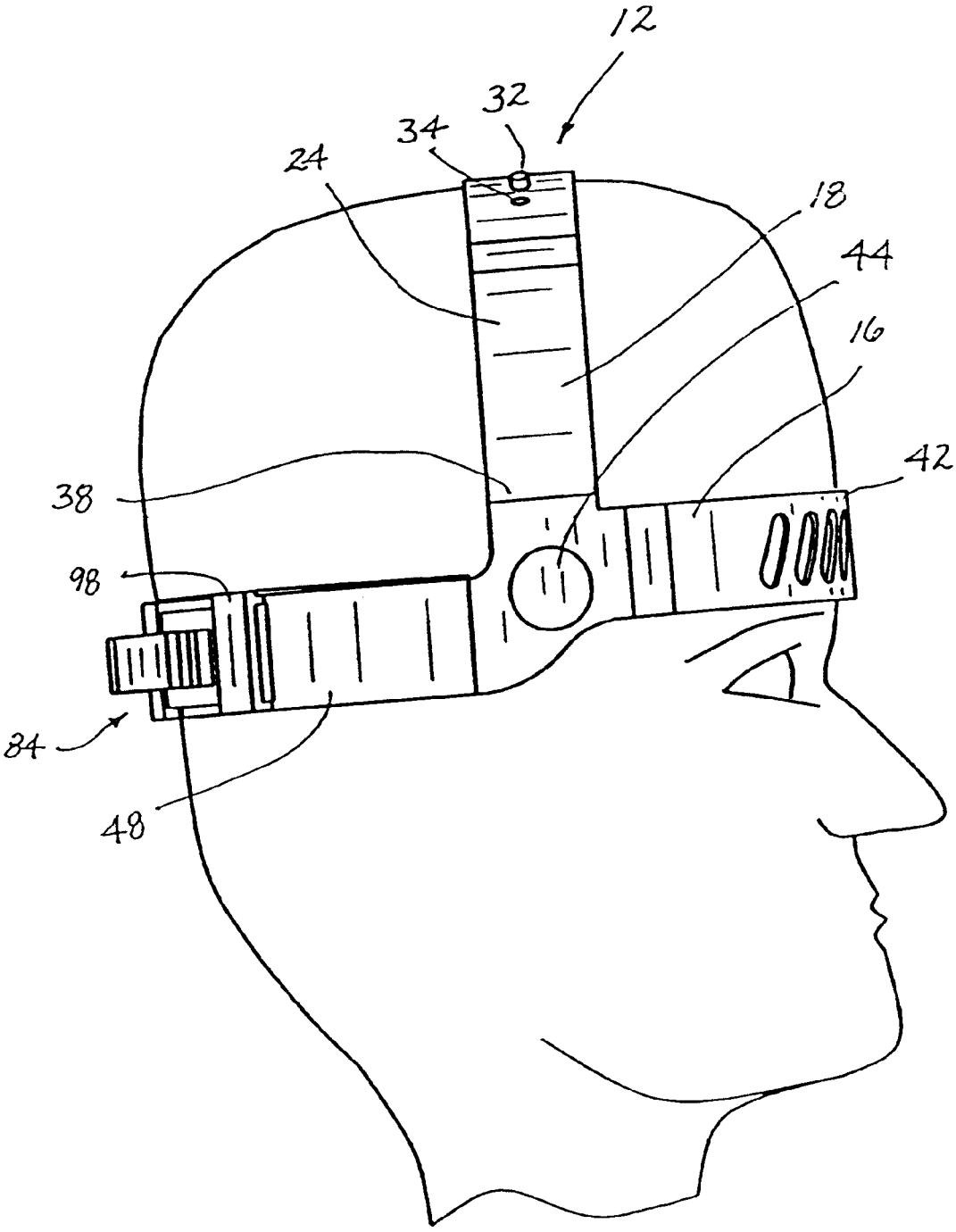
FIG. 6 is a side elevation view illustrating the headgear support adjusted to the size of a user's head.

The one-piece adjustable headgear support of the invention is designed to be used with a variety of different types of protective headgear. FIG. 1 shows the headgear support 12 employed with a welding helmet 14. However, the welding helmet 14 is only one example of the type of protective headgear with which the headgear support 12 may be used. For example, the headgear support 12 could be used with construction hard hats, fire fighters' helmets and other types of headgear. In addition, the headgear need not necessarily be protective of the user's head. The headgear support is designed to provide comfortable, lightweight and inexpensive support to any type of headgear.

In the preferred embodiment the headgear support 12 is constructed as one-piece to reduce its manufacturing cost. Preferably, a plastic material is used in forming the headgear support 12 in its one-piece construction. The one-piece support includes a headband 16 that wraps around the user's head and a crossover band 18 that extends over the user's head. Again, both the headband 16 and the crossover strap 18 are constructed as one piece, preferably from plastic.

The crossover strap 18 has first 22 and second 24 parts that each extend upwardly from the headband 16 to their respective distal ends 26, 28. The two parts 22, 24 of the crossover strap are provided with an adjustment mechanism in the form of a projecting post 32 adjacent the distal end 26 of the first part 22 and a series of complementary holes 34 adjacent the second end 28 of the second part 24. By inserting the post 32 in a selected one of the holes 34 the length of the strap between its proximal ends 36, 38 that extend integrally from the headband 16 can be adjusted. Crossover straps of this type are known in the art.

The headband 16 includes a forward portion 42 that extends between the proximal ends 36, 38 of the crossover strap 18. This forward portion 42 of the headband passes across the forehead of a person wearing the headgear support.

In the illustrated embodiment of the headgear support 12 shown in the drawing figures, the support has a pair of pivot adjustment mechanisms 44 mounted on the headband 16 adjacent the proximal ends 36, 38 of the crossover strap. These pivot adjustment mechanisms 44 attach the headgear support 12 to the welding helmet 14 and enable the welding helmet to be pivoted rearwardly and forwardly over the head of a wearer of the headgear support 12. The pivot mechanisms 44 are known in the art and when the headgear support 12 is used with an other type of headgear that does not require the pivoting movement, the pivot mechanisms 44 are replaced by other known attachment mechanisms that attach the headgear support 12 to the headgear.

The headband also has first 46 and second 48 straps that extend rearwardly from the connection of the headband to the crossover strap 18 to their respective distal ends 52, 54. The first strap 46 has an interior surface 56 that lies against the back of a user's head and an opposite exterior surface 58. A series of catches or ratchet teeth 62 are provided on the first strap exterior surface 58 extending along the surface for a distance from the first strap distal end 52. Each of the catches or teeth 62 has a tapered surface 64 that faces toward the first strap distal end 52 and a locking surface 66 that projects perpendicularly from the strap exterior surface 58. The series of teeth 62 are centered on the strap exterior surface 58 with smooth margin surfaces 68 above and below the series of teeth. A first strap finger abutment 72 also projects from the first strap exterior surface 58. The finger abutment 72 has a general triangular configuration and cross section and is positioned on the opposite side of the series of teeth 62 from the strap distal end 52. The series of ratchet teeth 62 and the finger abutment 72 are all formed integrally with the first strap 46.

The second strap 48 also has opposite interior 74 and exterior 76 surfaces with the interior surface 74 lying against the back of a user's head. A connector is formed on the exterior surface 76 adjacent the strap distal end 54. The connector includes two pairs of guide flanges 78, 82 that extend outwardly from the respective top and bottom edges of the second strap 48 and over the exterior surface 76 of the strap. The pairs of flanges 78, 82 extend outwardly from the strap exterior surface 76 a distance that is slightly larger than the thickness of the first strap 46 and extend over the second strap exterior surface 76 a distance that is slightly smaller than the top and bottom margin surfaces 68 of the first strap. The connector also includes a clasp 84 that is mounted to the second strap 48 by a pair of resilient, torsion arms 86, 88. Like the pairs of flanges 78, 82, the two torsion arms 86, 88 project outwardly from the top and bottom edges of the strap a distance that is slightly larger than the thickness of the first strap 46, and then extend over the second strap exterior surface 76 to where they connect with the clasp 84. The clasp 84 includes a pawl 92 that extends from the torsion arms 86, 88 away from the second strap distal end 54 and toward the strap exterior surface 76. The opposite end of the clasp 84 has a finger tab 94 that extends from the pair of torsion arms 86, 88 toward the second strap distal end 54 and over the strap exterior surface 76. The clasp 84 also includes a second finger abutment 96 that projects outwardly from the clasp between the torsion arms 86, 88. As stated above, the pair of torsion arms 86, 88 are resilient and bias the pawl 92 toward the second strap exterior surface 76. A guide bar 98 projects outwardly from the top and bottom edges of the second strap 48 and over the second strap exterior surface 76. The guide bar 98 is positioned out from the second strap exterior surface 76 a sufficient distance to allow the first strap 46 and the series of ratchet teeth 62 to pass beneath the guide bar. The pairs of flanges 78, 82, the clasp 84, the pair of torsion arms 86, 88, the clasp pawl 92, the clasp finger tab 94, the second finger abutment 96, and the guide bar 98 are all formed integrally on the second strap 48. In the preferred embodiment all of these component parts are molded as a single piece of plastic.

In use, the first strap end 52 is inserted into the connector portion of the second strap end 54 so that the edge margins 68 of the first strap end pass beneath the pairs of flanges 78, 82 and the series of teeth 62 pass beneath the clasp pawl 92. The resilience of the torsion arms 86, 88 bias the pawl 92 against the ratchet teeth 62. As the first strap end 52 is pushed through the pairs of flanges 78, 82 the tapered surfaces 64 of the teeth cause the pawl 92 to slide over the teeth against the bias of the torsion arms 86, 88 and thereby ratchet over the teeth. For finer adjustment of the headband on the user's head, the user positions their thumb and forefinger outside the first finger abutment 72 and the second finger abutment 96 and squeezes the two abutments toward each other, thus reducing the diameter or loop of the headband and adjusting it to the size of the user's head using only one hand. The resilience of the torsion arms 86, 88 holds the pawl 92 against the first end 52 of the strap with the pawl engaging against the locking surface 66 of one of the teeth, thereby securely holding the headband in its adjusted size. To release the strap, the user presses the finger tab 94 of the clasp 84 causing the pawl 92 to pivot about the torsion arms 86, 88 and out of engagement with the locking surface 66 of the tooth. With the pawl 92 released from the tooth locking surface 66 the user can insert their fingers beneath the strap second end 54 and pull the strap second end 54 from the strap first end 52, thereby increasing the size of the headband by using only one hand. Thus, the one-piece construction of the headgear support of the invention provides an inexpensive and lightweight support for headgear that can be easily adjusted to a smaller size or a larger size using only one hand.

While the present invention has been described by reference to specific embodiments, it should be understood that modifications and variations of the invention may be constructed without departing from the scope of the invention defined in the following claims.

What is claimed:

1. A headgear support, comprising:

a headband having a first end, a second end, an interior surface, and an exterior surface;

a plurality of ratchet teeth extending from the exterior surface of the headband adjacent the first end thereof, each of the ratchet teeth having a tapered surface and a locking surface; and a clasp resiliently connected to the exterior surface of the headband adjacent the second end thereof, the clasp having pawl and the clasp biased in a locking position wherein the pawl is engageable with the locking surface of one of the ratchet teeth to hold the headband in a selected loop configuration, the clasp movable to a release position wherein the pawl is moved away from the ratchet teeth to permit the loop configuration of the headband to be increased in size, wherein the headband, the plurality of ratchet teeth, the clasp, and the pawl of the clasp are formed as a monolithic unit.

2. The headgear support of claim 1 wherein the clasp is connected to the second end of the headband by a pair of resilient arms which bias the clasp in the locking position and which provide a gap between the clasp and the second end of the headband, the first end of the headband being insertable through the gap to pass the plurality of ratchet teeth between the clasp and the second end of the headband.

3. The headgear support of claim 2 wherein the pawl projects from one side of the pair of resilient arms toward the second end of the headband and wherein the clasp further has a finger tab which projects from an opposite side of the pair of resilient arms so that upon exertion of a force on the finger tab toward the exterior surface of the headband, the clasp is caused to move to the release position and upon releasing the finger tab, the clasp is caused to return to the locking position.

4. The headgear support of claim 3 further comprising a first finger abutment projecting outwardly from the exterior surface of the headband adjacent the first end thereof and wherein a second finger abutment projects outwardly from the clasp such that the first and second finger abutments can be squeezed together by a single hand of a user of the headgear support to cause the ratchet teeth to move over the pawl and thereby decrease the size of the loop configuration of the headband.

5. A headgear support, comprising:

a headband having a first end, a second end, an interior surface, and an exterior surface;

a plurality of ratchet teeth extending from the exterior surface of the headband adjacent the first end thereof, each of the ratchet teeth having a tapered surface and a locking surface; and a clasp resiliently connected to the exterior surface of the headband adjacent the second end thereof, the clasp having a pawl and the clasp biased in a locking position wherein the pawl is engageable with the locking surface of one of the ratchet teeth to hold the headband in a selected loop configuration, the clasp movable to a release position wherein the pawl is moved away from the ratchet teeth to permit the loop configuration of the headband to be increased in size; and a pair of flanges formed on the headband adjacent the clasp, the pair of flanges projecting over at least a portion of the exterior surface of the headband adjacent the clasp so as to form a pair of gaps between the flanges and the exterior surface of the headband such that the first end of the headband is insertable through the gaps between the flanges and the exterior surface of the headband to guide the first end of the headband along the second end of the headband, wherein the headband, the plurality of ratchet teeth, the clasp, the pawl of the clasp, and the flanges are formed as a monolithic unit.

6. The headgear support of claim 5 wherein the clasp is connected to the second end of the headband by a pair of resilient arms which bias the clasp in the locking position and which provide a gap between the clasp and the second end of the headband, the first end of the headband being insertable through the gap to pass the plurality of ratchet teeth between the clasp and the second end of the headband.

7. The headgear support of claim 6 wherein the pawl projects from one side of the pair of resilient arms toward the second end of the headband and wherein the clasp further has a finger tab which projects from an opposite side of the pair of resilient arms so that upon exertion of a force on the finger tab toward the exterior surface of the headband, the clasp is caused to move to the release position and upon releasing the finger tab, the clasp is caused to return to the locking position.

8. The headgear support of claim 7 further comprising a first finger abutment projecting outwardly from the exterior surface of the headband adjacent the first end thereof and wherein a second finger abutment projects outwardly from the clasp such that the first and second finger abutments can be squeezed together by a single hand of a user of the headgear support to cause the ratchet teeth to move over the pawl and thereby decrease the size of the loop configuration of the headband.

* * * * *